US007198117B2

(12) United States Patent
Uitto

(10) Patent No.: US 7,198,117 B2
(45) Date of Patent: Apr. 3, 2007

(54) METHOD AND ARRANGEMENT FOR CONTROLLING PERCUSSION ROCK DRILLING

(75) Inventor: Vesa Uitto, Tampere (FI)

(73) Assignee: Sandvik Tamrock Oy, Tampere (FI)

( * ) Notice: Subject to any disclaimer, the term of this patent is extended or adjusted under 35 U.S.C. 154(b) by 0 days.

(21) Appl. No.: 10/913,365

(22) Filed: Aug. 9, 2004

(65) Prior Publication Data

US 2005/0006143 A1 Jan. 13, 2005

Related U.S. Application Data

(63) Continuation of application No. PCT/FI03/00127, filed on Feb. 20, 2003.

(30) Foreign Application Priority Data

Feb. 22, 2002 (FI) ..... 20020352

(51) Int. Cl.
*E21B 44/00* (2006.01)
*E21B 19/08* (2006.01)

(52) U.S. Cl. ..... 175/27; 175/24; 173/8; 173/9; 173/11

(58) Field of Classification Search ..... 175/24, 175/27; 173/4, 6, 9, 11, 8
See application file for complete search history.

(56) References Cited

U.S. PATENT DOCUMENTS 3,971,449 A * 7/1976 Nylund et al. ..... 175/27
5,348,106 A 9/1994 Mattero
5,358,058 A * 10/1994 Edlund et al. ..... 175/24
5,771,981 A 6/1998 Briggs et al.

FOREIGN PATENT DOCUMENTS

EP 0112810 A2 7/1984
EP 0825330 A1 2/1998

* cited by examiner

*Primary Examiner*—David Bagnell
*Assistant Examiner*—Giovanna M Collins
(74) *Attorney, Agent, or Firm*—Drinker Biddle & Reath LLP

(57) ABSTRACT

The invention relates to a rock drilling arrangement and a method and program for controlling rock drilling on the basis of specific energy consumption. The specific energy of drilling is the quantity of energy used per a unit of length of the drilled hole. Not only the used impact energy, but also the energy used by at least one other sub-process is taken into account when determining the specific energy. Rotation energy is typically included, but feeding energy and flushing energy can also be considered. Drilling variables are adjusted so that the specific energy is of a predetermined size.

12 Claims, 1 Drawing Sheet

METHOD AND ARRANGEMENT FOR CONTROLLING PERCUSSION ROCK DRILLING

FIELD OF THE INVENTION

The invention relates to a method for controlling percussion rock drilling that comprises the four sub-processes of percussion, rotation, feed and flushing that are controlled by adjusting drilling variables, the method comprising at least: determining the penetration rate and percussion power of a rock drilling machine; transmitting the obtained results to a control device of the rock drilling machine that contains a control strategy for controlling drilling; using the obtained results in controlling drilling. The invention further relates to a program intended for execution in a control device of a rock drilling machine arranged to control the rock drilling process. In addition, the invention relates to a rock drilling arrangement.

BACKGROUND OF THE INVENTION

In percussion rock drilling, impact pulses are provided to a tool by a percussion device in a rock drilling machine, whereby the drill bits at the outermost end of the tool penetrate the rock and break it. At the same time, the tool is pressed by means of a feeding device against the rock in such a manner that the contact between the tool and the rock remains and an as large proportion of the impact energy as possible is transmitted to the rock. Further, so as to provide effective impacts, the tool should be indexed by means of a rotating device between the impacts in such a manner that the drill bits hit a new location with every impact. The detached rock material is flushed away from the drill hole with a suitable medium. Percussion rock drilling thus has four sub-processes of drilling: percussion, feed, rotation and flushing. Drilling variables, in turn, include percussion power, impact energy, impact frequency, feeding power, feeding rate, rotating rate, rotating torque, flushing flow and flushing pressure. By adjusting the drilling variables, it is possible to affect the sub-processes of drilling and the efficiency of drilling.

Publication EP 0,112,810 discloses the adjustment of percussion power to achieve a maximum penetration rate. In the disclosed solution, the striking rate and impact frequency of a percussion piston are adjusted independently, which is possible in very few rock drilling machines, since it requires the adjustment of the stroke length. In typical pressure medium-operated percussion devices, the length of the stroke is constant and only the impact pressure and flow can be adjusted, and any changes made in them simultaneously affect both the striking rate and impact frequency. Further, a drawback with the solution described in the EP publication is that the control of drilling is only directed to adjusting the percussion power. As is known in the field, rock drilling is, however, a complex process, and to effectively control it in the manner described in the EP publication, by adjusting only one drilling variable, is not possible.

BRIEF DESCRIPTION OF THE INVENTION

It is an object of the present invention to provide a novel and improved manner of controlling percussion rock drilling by using the specific energy consumption of drilling as the basis for adjusting drilling variables.

The method of the invention is characterized by determining in addition to the percussion power also the power used in at least one other sub-process; calculating the ratio of the total power used by the examined sub-processes to the penetration rate to determine the total specific energy used in drilling; and adjusting the drilling variables so that the predetermined total specific energy is used in drilling.

The program of the invention is characterized in that the execution of the program in the control device is arranged: to determine the ratio of the total power used by at least two monitored sub-processes to the penetration rate to determine the total specific energy used in drilling; and to adjust the drilling variables so that the predetermined total specific energy is used in drilling.

The rock drilling arrangement of the invention is characterized in that the arrangement also comprises means for determining the power used by at least one other sub-process; and that the control device is arranged to adjust the drilling variables in such a manner that the ratio of the total power used by the examined devices to the penetration rate during drilling is as predetermined.

The second method of the invention is characterized by determining not only the percussion power but also the power used by at least one other sub-process; calculating the ratio of the total power used by the examined sub-processes to the penetration rate to determine the total specific energy used in drilling; and adjusting the drilling variables so that the predetermined total specific energy is used in drilling.

The essential idea of the invention is that to determine the specific energy of drilling, the penetration rate of drilling is measured and the power used in drilling is determined. Specific energy is a quotient of the power and penetration rate used in drilling, calculated in the control unit of the rock drilling machine on the basis of measurement results. The unit of measure of specific energy is then kWh/m or J/m. Specific energy can also be determined for drilled volume, i.e. the used power is divided by the product of the cross-sectional area of the hole and the penetration rate. The unit of measure of specific energy is then $kWh/m^3$ or $J/m^3$. In determining the specific energy, at least the percussion process and one other sub-process of drilling are taken into consideration. Typically, the rotation process is considered, but if necessary, the two remaining sub-processes, i.e. feed and flushing, can also be included. The ratio of the power used by the examined sub-processes to the penetration rate is called the total specific energy. Drilling is controlled by adjusting the drilling variables so that the predetermined total specific energy is used in drilling.

The invention provides the advantage that the control is able to monitor several sub-processes of drilling simultaneously and to adjust in a versatile manner the drilling variables that affect the drilling process. A further advantage is that the control of the invention is independent of the construction details and operating principle of the rock drilling machine.

The essential idea of an embodiment of the invention is to control drilling by adjusting the drilling variables so that minimum specific energy is used in drilling. An as large proportion as possible of the energy used in drilling can then be directed to the main purpose, i.e. breaking the rock, whereby the proportion of energy used in producing heat and various transformations remains small.

The essential idea of an embodiment of the invention is to adjust the drilling variables in predetermined drilling situations in such a manner that the total specific energy determined for each situation is used in drilling. It is then possible for instance to allow a higher specific energy value for initial drilling so that the hole is started carefully and exactly. In other special situations, such as in reaming, it is also possible to allow a specific energy value that is higher than in normal drilling. In normal drilling, the drilling is preferably done with minimum specific energy.

The essential idea of an embodiment of the invention is to determine the power used in each sub-process of drilling and to determine the specific energies of the sub-processes. Further, a weighting coefficient is determined for each sub-process, and the specific energies multiplied by the weighting coefficients are then summed to obtain as the final product the weighted total specific energy. The weighting coefficients can be used to weight as desired the various sub-processed of drilling in such a manner that the significance of certain sub-processes for drilling can as necessary be weighted higher or lower than the significance of the sub-process would be on the basis of its energy consumption only. Thus, it is for instance possible to emphasize the significance of the feed process, which consumes only a little energy, for the total situation, since it is known that too high a feed rate may cause considerable problems for the process and the equipment. On the other hand, excessive flushing does not, to a limit, cause any essential problems, with the exception of energy consumption, so for flushing the weighting can remain low.

BRIEF DESCRIPTION OF THE FIGURES

The invention will be described in greater detail in the attached drawing, in which.

For the sake of clarity, the invention is shown in a simplified manner in the figures. Similar parts are marked with the same reference numerals in the figures.

DETAILED DESCRIPTION OF THE INVENTION

Figure 1:
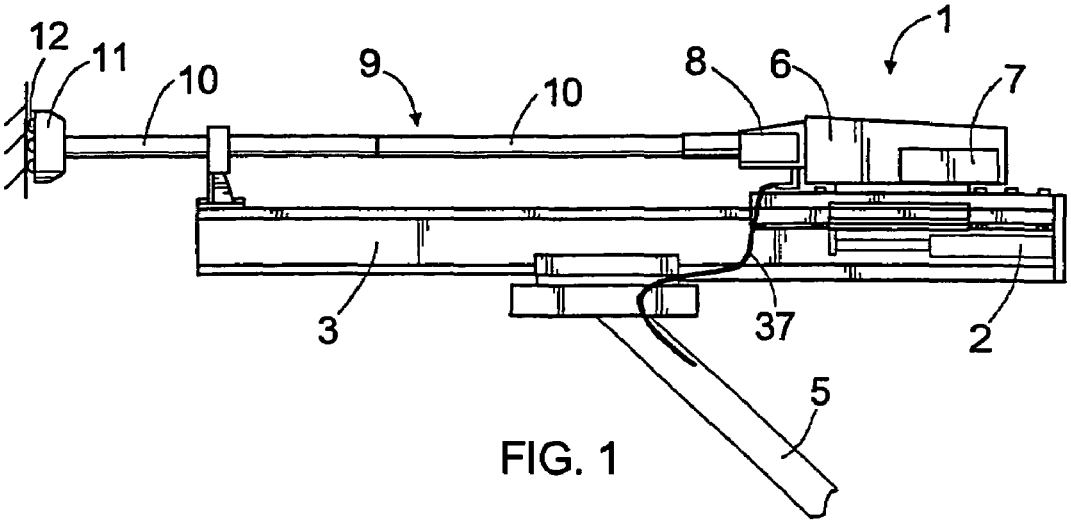
FIG. 1 is a schematic side view of a rock drill arrangement.

FIG. 1 shows a typical rock drilling machine 1 used in percussion rock drilling that can be moved with a feeding device 2 in relation to a feeding beam 3. The feeding beam 3 is typically arranged to the free end of a boom 5 arranged to the carrier of a rock drilling device. The feeding device 2 is usually a hydraulic cylinder, from which power is transmitted by means of a wire, chain or some other suitable power transmission means to the rock drilling machine 1. The rock drilling machine 1 comprises a percussion device 6, a rotating device 7 and a shank 8, which the percussion device 6 hits and which the rotating device 7 endeavours to rotate. A tool 9, which typically comprises one or more drill rods 10 and a drill bit 11 with its button bits 12 at the outermost free end of the drill rod, can be connected to the shank 8 located at the front end of the rock drilling machine 1. The tool 9 can also be one uniform piece with the button bits 12 fastened to its free end.

Figure 2:
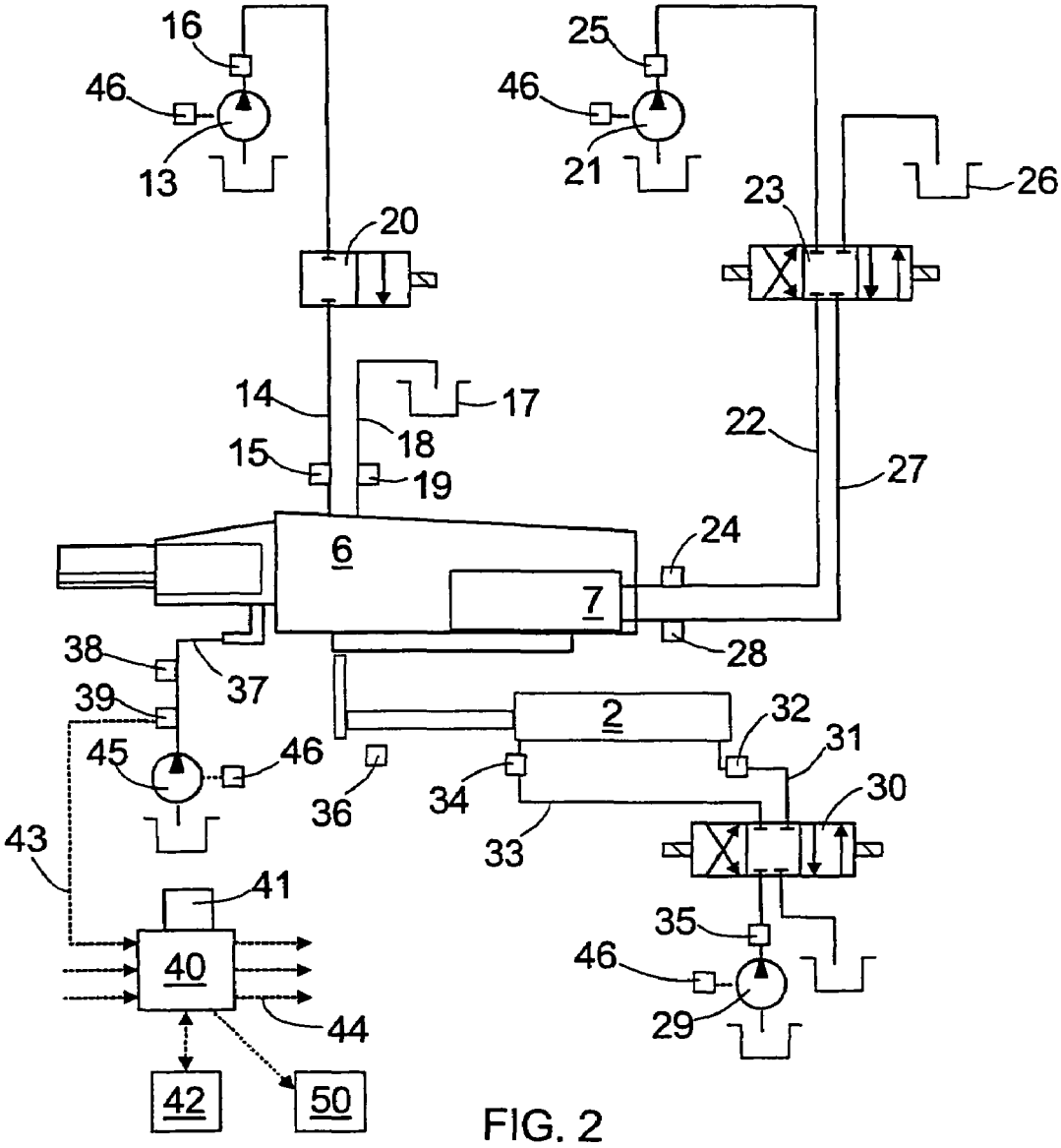
FIG. 2 is a schematic view of an arrangement of the invention for controlling rock drilling.

FIG. 2 illustrates a control system of the invention with reference to a hydraulically operated rock drilling machine. The percussion device 6, rotating device 7 and feeding device 2 of the rock drilling machine are then operated by the pressure of a pressure fluid. A pressure sensor 15 and flow sensor 16 are arranged to a working pressure channel 14 leading from a hydraulic pump 13 to the percussion device 6. A pressure sensor 19 is arranged to a return channel 18 leading from the percussion device 6 to a tank 17. The pressure sensors 15 and 19 are preferably arranged as close to the percussion device 6 as possible. Further, the working pressure channel 14 has a valve 20 for controlling the pressure fluid flow acting on the percussion device 6. A pressure fluid flow is in turn led to the rotating device 7 from a hydraulic pump 21 along a working pressure channel 22 controlled by a valve 23. A pressure sensor 24 is arranged to the working pressure channel 22. The channel coming from the pump 21 also has a flow sensor 25. A pressure sensor 28 is arranged to a return channel 27 leading from the rotating device 7 to a tank 26. In this context, the working pressure channel 22 refers to the channel to which the pressure fluid flow is led when the tool is rotated in the normal rotating direction. Further, a pressure sensor 32 is arranged to a first channel 31 leading from a valve 30 to the feeding device 2, and correspondingly, another pressure sensor 34 is arranged to a second channel 33. The pressure fluid flow from a hydraulic pump 29 is measured with a flow sensor 35. The feeding device 2 can have a sensor 36 for monitoring the penetration rate of the rock drilling machine 1. Flushing medium is led to the rock drilling machine 1 along a flushing medium channel 37. A pressure sensor 38 and flow sensor 39 are arranged to the flushing medium channel 37. For the sake of clarity, no elements related to the control of the flushing medium are shown in the figure.

FIG. 2 also shows a control device 40 of the rock drilling machine that is arranged to control the percussion device 6 and rotating device 7 belonging to the rock drilling machine and further, the feeding device 2 of the rock drilling machine and the input of the flushing medium. The control device 40 typically comprises one or more computers or corresponding control devices, such as a programmable logic that is capable of deciding the necessary control actions on the basis of basic information and measuring values entered into it. The control device 40 comprises a data communications connection. The data communications connection can be a reading device 41 for reading memory elements, such as memory disks, or it can comprise means for communicating over wire or wirelessly with an external memory or control device 42. The sensors 15, 16, 19, 24, 25, 28, 32, 34, 35, 36, 38 and 39 transmit measuring data to the control device 40. For the sake of clarity, FIG. 2 only shows the connection 43 between the flow sensor 39 and control device 40 in its entirety. For the sake of clarity, the connections 44 from the control device 40 to adjustment devices are shown in a simplified manner in FIG. 2. In a hydraulic rock drilling machine, the adjustment devices can include various valves, throttles and the like that are capable of acting on the pressure and flow of the pressure fluid flowing in the pressure fluid channel. The hydraulic pumps can also be adjustable pumps.

Further, FIG. 2 shows a measuring unit 46 arranged to the pumps 13, 21, 29 and 45 for determining on the basis of the operating rate and displacement capacity of the pump the volume flow produced by the pump at each time. When using the measuring unit 46, the flow sensors 16, 25, 35 and 39 can be left out, if desired. However, when the percussion device, rotating device and feeding device are run by the pressure fluid flow provided by one or more common hydraulic pumps, the pressure fluid flow led to each device must be measured separately from the pressure line of each device so that the specific energies of the sub-processes can be calculated.

Specific Energy

Specific energy is calculated by dividing the total power $P_{TOT}$ used in drilling by the net penetration rate NPR. This produces the parameter SE (Specific Energy) that indicates the energy used per each unit of length of the drilled hole.

Alternatively, it is possible to determine the energy consumption per each unit of volume, since the volume of rock detached by drilling can be calculated from the penetration rate and the dimensions of the tool. A small SE value characterizing efficient drilling means that the energy fed to the rock drilling machine is efficiently used to detach rock material. In other words, specific energy indicates the efficiency of drilling.

Example of Calculating Specific Energy

This example shows how the total specific energy of a hydraulically operated percussion rock drilling machine and the specific energies of the sub-processes can be determined.

Specific energy can be calculated using the following formula:

$$SE_{TOT}=P_{TOT}/NPR,$$

or alternatively the formula:

$$SE_{TOT}=P_{TOT}/(NPR*A_{HOLE}),$$

wherein $A_{HOLE}$ is the cross-sectional area of the hole to be drilled.

The penetration rate NPR can be determined for instance by measuring by means of a suitable sensor or measuring device the movement of the rock drilling machine on the feeding beam or alternatively, by measuring the feeding movement of the feeding device. Further, when using a hydraulic cylinder as the feeding device, the penetration rate can be calculated on the basis of the volume of pressure fluid flow led into the cylinder. Other suitable solutions for determining the penetration rate can naturally also be applied.

The total power $P_{TOT}$ used in drilling is determined by summing the powers used by the examined sub-processes. The powers of the sub-processes include the percussion power $P_{PERC}$, rotating power $P_{ROT}$ and feeding power $P_{FEED}$. If necessary, it is also possible to include the flushing power $P_{FLUSH}$, even though the significance of the flushing power is usually minor.

The percussion power $P_{PERC}$ fed to a hydraulic percussion device can be calculated as follows:

$$P_{PERC}=(p_{PERC,\,P}-p_{PERC,\,T})*Q_{PERC}$$

wherein:

$p_{PERC,\,P}$=the pressure of the pressure line going to the percussion device, i.e. the working pressure $p_{PERC,\,T}$=the pressure of the pressure line returning from the percussion device, i.e. the return pressure $Q_{PERC}$=the flow of pressure fluid going to the percussion device.

$p_{PERC,\,P}$ can be measured with a pressure sensor arranged to the pressure line going to the percussion device. The measurement is made as close as possible to the percussion device so that possible pressure losses caused by the hydraulic channel are eliminated. On the other hand, if the pressure sensor for some reason cannot be located close to the percussion device, but it is on the carrier of the rock drilling device, for instance, the proportion of various losses can be compensated computationally in the control unit of the rock drilling machine.

$p_{PERC,\,T}$ can be measured with a pressure sensor arranged to the pressure channel leading from the percussion device to the tank. In some cases, the return pressure is not measured, but can be determined by calculation or assumed to be insignificant.

$Q_{PERC}$ can be measured with a flow sensor arranged to the pressure line going to the percussion device. Alternatively, the flow rate of pressure fluid led to the percussion device can be calculated on the basis of the displacement volume and operating rate of the hydraulic pump. The displacement volume is a structural property of a hydraulic pump. The operating rate can in turn be determined with a sensor arranged to the pump. Further, the flow rate to the percussion device can be determined sufficiently accurately computationally in the control unit of the rock drilling machine. The operating frequency of the percussion device is then determined from the pulse frequency obtained on the basis of the measuring results of the pressure $p_{PERC,\,P}$ fed to the percussion device. The flow rate to the percussion device is obtained by multiplying the operating frequency by the displacement volume based on the physical dimensions of the percussion device.

Further, one alternative for determining the percussion power $P_{PERC}$ is to measure with suitable sensors the impact frequency and impact energy from the drill rod. The percussion power is then the product of the impact frequency and impact energy.

Power can thus be determined either from the input or output power of the sub-process.

The rotating power $P_{ROT}$ fed to a hydraulic rotating device can be calculated as follows:

$$P_{ROT}=(p_{ROT,A}-p_{ROT,B})*Q_{ROT}$$

wherein:

$p_{ROT,A}$=the pressure of the pressure line A of the rotating device $p_{ROT,B}$ the pressure of the pressure line B of the rotating device $Q_{ROT}$=the flow of pressure fluid into the rotating device.

The pressure of pressure fluid is fed into the pressure line A when the tool is rotated into the normal rotating direction. Working pressure then prevails in the pressure line A and correspondingly, the return pressure led from the rotating device to the tank in the pressure line B. The working pressure and return pressure of the rotating device can be determined in the same way as the working pressure and return pressure of the percussion device. Further, it is also possible to ignore the return pressure or it can be determined by calculation.

$Q_{ROT}$ can be measured with a flow sensor arranged to the pressure line going to the rotating device. Alternatively, the flow rate of pressure fluid led to the rotating device can be calculated on the basis of the displacement volume and operating rate of the hydraulic pump. The displacement volume is a structural property of a hydraulic pump and the operating rate can be determined with a sensor arranged to the pump, for instance. Alternatively, it is possible to measure the rotating rate of the rock drilling machine and to determine $Q_{ROT}$ on the basis of the obtained rotating rate and the displacement volume of the rotating motor.

If necessary, the rotating power $P_{ROT}$ can be determined by determining the output power instead of the input power described above. The output power can be determined by means of the rotating rate and rotating torque.

The feeding power $P_{FEED}$ fed into a hydraulic feeding device, in which the actuator is a hydraulic motor, can be calculated as follows:

$$P_{FEED}=(p_{FEED,A}-p_{FEED,B})*Q_{FEED}$$

wherein:

$p_{FEED,A}$=the pressure of the pressure line A of the feeding device $p_{FEED,B}$=the pressure of the pressure line B of the feeding device $Q_{FEED}$=the flow of pressure fluid into the feeding device.

The pressure of pressure fluid is fed into the pressure line A of the feeding device during drilling, i.e. when the rock drilling machine is fed against the rock. Working pressure then prevails in the pressure line A and the return pressure of the feeding device prevails in the pressure line B. The working pressure and return pressure of the feeding device can be determined in the same way as those of the percussion device. Further, because during drilling, the flow rate directed to the feeding device is quite low, the return pressure can be ignored.

If the actuator of the feeding device is a hydraulic cylinder, the different working surface areas of the cylinder chambers and the different flows in the pressure lines A and B need to be taken into account. Otherwise, the calculation described above can be used.

$Q_{FEED}$ can be measured with a flow sensor arranged to the pressure line going to the feeding device. Alternatively, the flow rate of pressure fluid led to the feeding device can be calculated on the basis of the displacement volume and operating rate of the hydraulic pump. $Q_{FEED}$ can also be determined by means of the penetration rate, since the flow and penetration rate have an explicit dependency.

As regards the adjustment of feeding power, it can be noted that the magnitude of the used feeding force depends not only on percussion power, but also on the rock type, the dimensions of the hole being drilled and the used drilling equipment. In under-feed drilling, the transmission of percussion energy to the rock is poor and the risk of damage to the drilling equipment increases, because the threaded couplings between the drill rods tend to open. Rotation resistance is low in under-feeding. Over-feeding in turn causes problems in flushing and the endurance of the drilling equipment. Over-feeding also reduces the penetration rate.

The power $P_{FLUSH}$ used for flushing can be calculated as follows:

$$P_{FLUSH}=(p_{FLUSH})*Q_{FLUSH}$$

wherein:

$p_{FLUSH}$=the pressure of the flushing medium channel $Q_{FLUSH}$=the flow of the flushing medium channel.

$p_{FLUSH}$ can be measured with a pressure sensor arranged to the flushing medium channel and correspondingly, $Q_{FLUSH}$ can be measured with a flow sensor arranged to the flushing medium channel.

On the basis of the above power calculations, it is easy to determine the specific energies of each sub-process of drilling. In the following formulas, the denominator NPR can, if desired, be replaced by the product (NPR*$A_{HOLE}$), whereby the size of the hole being drilled is taken into account. In the latter case, too, the matter concerns the ratio of the used power to the penetration rate.

The specific energy of the percussion process can be calculated as follows:

$$SE_{PER}=P_{PER}/NPR$$

The specific energy $SE_{ROT}$ of the rotating process can be calculated as follows:

$$SE_{ROT}=P_{ROT}/NPR$$

The specific energy $SE_{FEED}$ of the feeding process can be calculated as follows:

$$SE_{FEED}=P_{FEED}/NPR$$

The specific energy $SE_{FLUSH}$ of the flushing process can be calculated as follows:

$$SE_{FLUSH}=P_{FLUSH}/NPR$$

In practice, drilling is usually done with a desired total specific energy level that is typically the minimum level. During drilling, the control device of the rock drilling machine monitors the total specific energy and if it detects any deviations, it adjusts the drilling variables so as to again achieve the predetermined total specific energy level. Which sub-processes and drilling variables to adjust in each case, the control device decides firstly on the basis of whether the total specific energy increases or decreases and secondly on the basis of how the change in the total specific energy has affected the specific energies of the examined sub-processes.

Examples of Control Strategies

This example describes some alternative control strategies that can possibly be used in the control device, with the percussion and rotating processes used as the examined sub-processes.

Case 1:

$SE_{TOT}$ increases, $SE_{PERC}$ increases, $SE_{ROT}$ does not change.

In this situation, the control device decides that drilling is for some reason under-feeding or a harder rock has been encountered. The control device increases the feed pressure to increase the penetration rate. As the penetration rate increases, the total specific energy $SE_{TOT}$ decreases back to the desired level.

Case 2:

$SE_{TOT}$ increases, $SE_{PERC}$ does not change, $SE_{ROT}$ increases.

In this situation, the control device decides that drilling is for some reason over-feeding. Alternatively, the rotating torque has increased due to a clay layer. The control device lowers the feed pressure to eliminate possible over-feeding.

Case 3:

$SE_{TOT}$ decreases, $SE_{PERC}$ decreases, $SE_{ROT}$ does not change.

In this situation, the control device decides that a softer rock than before is being drilled. The control device reduces the impact pressure.

Case 4:

$SE_{TOT}$ decreases strongly, $SE_{PERC}$ decreases, $SE_{ROT}$ decreases.

In this situation, the control device decides that an essentially softer rock than before is being drilled. Alternatively, this can be interpreted so that the drill bit has hit a cavity. The control device reduces the impact pressure significantly. Drilling is continued with half the percussion power, for instance.

Several drill holes are often drilled side by side into the rock. It can then be assumed that the rock material is similar in the adjacent holes. Thus, after one drill hole has be drilled and the drilling adjusted according to the invention, the drilling of the next drill hole can preferably be started by using as initial settings the drilling variables used in the previous hole. This way, the information obtained from the drilling of the previous hole can be utilized.

Further, the type and hardness of the rock being drilled can be estimated on the basis of measured specific energy consumption. In a simplified manner it can be said that hard rock requires more power per detached rock quantity than soft rock. On the other hand, strong and abrupt changes in the specific energy values indicate variations in the rock, such as fragmentation or clay stratification. The control device can comprise means, such as a computer program, for determining the type of the rock based on the specific energy.

The method of the invention can be executed by running a software product implementing the method in the control device of the rock drilling machine. The control device then comprises a computer with the software stored into its memory, or alternatively, the software can be downloaded into the computer from a data network, such as the Internet, or it can be downloaded from an external memory, such as the memory of a second computer or from a disk. For data transmission, the control device comprises means for establishing a data communications connection and/or a reading device for reading memory units. Further, the software can alternatively be implemented as a hardware solution.

Yet another possibility is to implement the invention in such a manner that the powers used by the examined sub-processes are registered in the control device 40. A processor in the control device 40 then calculates the penetration rate and the total specific energy used during drilling on the basis of the registered powers. Further, the control device 40 has a display 50, such as a monitor, gauge, signal light or the like, by means of which the calculated total specific energy is indicated to the operator of the rock drilling machine. The control of the rock drilling machine is then done by utilizing the data indicated on the display 50 and the empirical control strategy of the operator. In this solution, the control device 40 does not adjust the drilling variables, but the adjustment is manual. The display 50 further indicates the specific energy of each examined sub-process. It is advantageous for the control if the display 50 can indicate several specific energy values at a time as well as their trend.

The drawings and the related description are intended only to illustrate the idea of the invention. The invention may vary in detail within the scope of the claims. Thus, even though the invention is above described with reference to the operation of a hydraulic rock drilling machine, it is clear that the principle of the invention does not depend on how the impact pulse is achieved to the tool. The invention can thus also be applied to pneumatic and electric percussion devices, for instance. Correspondingly, the rotating device and feeding device can be electric actuators, for instance. The operation of electric actuators is adjusted by altering electric variables, such as current and voltage. The electric power of each sub-process, i.e. percussion, rotation, feed and flushing, of an electric rock drilling machine can be determined relatively easily for the purpose of calculating the specific energy.

What is claimed is:

1. A method for controlling percussion rock drilling that comprises the four sub-processes of percussion, rotation, feed and flushing that are controlled by adjusting drilling variables, the method comprising:

determining the penetration rate and percussion power of a rock drilling machine;

transmitting the obtained results to a control device of the rock drilling machine that contains a control strategy for controlling drilling;

using the obtained results in controlling drilling in accordance with the control strategy;

determining in addition to the percussion power also the power used in at least one other sub-process;

calculating the ratio of the total power used by the examined sub-processes to the penetration rate to determine the total specific energy used in drilling;

adjusting the drilling variables so that a specific energy that had been previously determined is used in drilling;

determining the specific energy of each examined sub-process by dividing the power used by each process by the penetration rate; and multiplying the specific energy of each sub-process by a predetermined weighting coefficient and summing the weighted specific energies of the sub-processes to determine the total specific energy.

2. A storage device including a program intended for execution in a control device of a rock drilling machine, the control device being arranged to control a rock drilling process comprising four sub-processes, namely percussion, rotation, feed and flushing, and wherein the execution of the program in the control device is arranged to:

determine the ratio of total power used by at least two monitored sub-processes to the penetration rate to determine the total specific energy used in drilling;

adjust drilling variables so that a predetermined total specific energy is used in drilling;

determine the specific energy of each examined sub-process by dividing the power used by each process by the penetration rate; and multiply the specific energy of each sub-process by a predetermined weighting coefficient and sum the weighted specific energies of the sub-processes to determine the total specific energy.

3. A rock drilling arrangement comprising:

a rock drilling machine comprising a percussion device for providing impact pulses through a tool connected to the rock drilling machine to the rock being drilled, and further a rotating device for rotating said tool around its axle;

a feeding device for moving the rock drilling machine in relation to the rock being drilled;

a flushing device for flushing the material detached during drilling;

a control device arranged to control one or more sub-processes of drilling, which are percussion, rotation, feed and flushing, and containing a control strategy for adjusting drilling variables;

means for determining the penetration rate of the rock drilling machine;

means for determining the power required by the percussion device;

means for determining the power used by at least one other sub-process;

means for determining the specific energy of each examined sub-process by dividing the power used by each process by the penetration rate; and means for multiplying the specific energy of each sub-process by a predetermined weighting coefficient and summing the weighted specific energies of the sub-processes to determine the total specific energy, wherein the control device is arranged to adjust the drilling variables in such a manner that during drilling, the ratio of the total power used by the examined devices to the penetration rate is as predetermined.

4. A method for controlling percussion rock drilling that comprises the four sub-processes for percussion, rotation, feed and flushing that are controlled by adjusting drilling variables, the method comprising at least:

determining the penetration rate and percussion power of a rock drilling machine;

transmitting the obtained results to a control device of the rock drilling machine;

using the obtained results in controlling drilling;

determining in addition to the percussion power the power used by at least one other sub-process;

calculating the ratio of the total power used by the examined sub-processes to the penetration rate to determine the total specific energy used in drilling;

adjusting the drilling variables so that a predetermined total specific energy is used in drilling;

determining the specific energy of each examined sub-process by dividing the power used by each process by the penetration rate; and multiplying the specific energy of each sub-process by a predetermined weighting coefficient and summing the weighted specific energies of the sub-processes to determine the total specific energy.

5. A method for controlling percussion rock drilling that comprises the four sub-processes of percussion, rotation, feed and flushing that are controlled by adjusting drilling variables, the method comprising:

determining the penetration rate and percussion power of a rock drilling machine;

transmitting the obtained results to a control device of the rock drilling machine that contains a control strategy for controlling drilling;

using the obtained results in controlling drilling in accordance with the control strategy;

determining in addition to the percussion power also the power used in at least one other sub-process;

determining the specific energy of each examined sub-process by dividing the power used by each process by the penetration rate;

calculating the ratio of the total power used by the examined sub-processes to the penetration rate to determine the total specific energy used in drilling;

adjusting the drilling variables so that a specific energy that had been previously determined is used in drilling; and monitoring the changes occurring in the specific energies of the sub-processes and selecting the drilling variable to be adjusted and the adjustment action on the basis of said monitoring and the control strategy in the control device.

6. A storage device including a program for execution in a control device of a rock drilling machine, the control device being arranged to control a rock drilling process comprising four sub-processes, namely percussion, rotation, feed and flushing, wherein execution of the program comprises:

determining the ratio of total power used by at least two monitored sub-processes to the penetration rate to determine the total specific energy used in drilling;

determining the specific energy of each examined sub-process by dividing the power used by each process by the penetration rate;

adjusting drilling variables so that a predetermined total specific energy is used in drilling; and monitoring changes occurring in the specific energies of the sub-processes and selecting the drilling variable to be adjusted and the adjustment action on the basis of said monitoring and a control strategy in the control device.

7. A rock drilling arrangement comprising:

a rock drilling machine including a percussion device for providing impact pulses through a tool connected to the rock drilling machine to the rock being drilled, and a rotating device for rotating said tool around its axle;

a feeding device for moving the rock drilling machine in relation to the rock being drilled;

a flushing device for flushing material detached during drilling;

a control device arranged to control one or more sub-processes of drilling, which are percussion, rotation, feed and flushing, and containing a control strategy for adjusting drilling variables;

means for determining the penetration rate of the rock drilling machine;

means for determining the power required by the percussion device;

means for determining the power used by at least one other sub-process;

means for determining the specific energy of each examined sub-process by dividing the power used by each process by the penetration rate; and means for monitoring changes occurring in the specific energies of the sub-processes and for selecting the drilling variable to be adjusted and the adjustment action on the basis of said monitoring and the control strategy in the control device;

wherein the control device is arranged to adjust the drilling variables in such a manner that during drilling, the ratio of the total power used by the examined devices to the penetration rate is as predetermined.

8. A method for controlling percussion rock drilling that comprises the four sub-processes of percussion, rotation, feed and flushing that are controlled by adjusting drilling variables, the method comprising:

determining the penetration rate and percussion power of a rock drilling machine;

transmitting the obtained results to a control device of the rock drilling machine that contains a control strategy for controlling drilling;

using the obtained results in controlling drilling in accordance with the control strategy;

determining in addition to the percussion power also the power used in at least one other sub-process;

calculating the ratio of the total power used by the examined sub-processes to the penetration rate to determine the total specific energy used in drilling; and adjusting in predetermined drilling situations the drilling variables in such a manner that the total specific energy predetermined for each drilling situation is used in drilling.

9. A storage device including a program for execution in a control device of a rock drilling machine, the control device being arranged to control a rock drilling process comprising four sub-processes, namely percussion, rotation, feed and flushing, wherein execution of the program comprises:

determining the ratio of total power used by at least two monitored sub-processes to the penetration rate to determine the total specific energy used in drilling; and adjusting in predetermined drilling situations the drilling variables in such a manner that the total specific energy predetermined for each drilling situation is used in drilling.

10. A rock drilling arrangement comprising:

a rock drilling machine including a percussion device for providing impact pulses through a tool connected to the rock drilling machine to the rock being drilled, and a rotating device for rotating said tool around its axle;

a feeding device for moving the rock drilling machine in relation to the rock being drilled;

a flushing device for flushing material detached during drilling;

a control device arranged to control one or more sub-processes of drilling, which are percussion, rotation, feed and flushing, and containing a control strategy for adjusting drilling variables;

means for determining the penetration rate of the rock drilling machine;

means for determining the power required by the percussion device;

means for determining the power used by at least one other sub-process; and wherein the control device is arranged to calculate the ratio of the total power used by the examined devices to the penetration rate to determine the total specific energy used in drilling; and wherein the control device is arranged to adjust in predetermined drilling situations the drilling variables in such a manner that the total specific energy predetermined for each drilling situation is used in drilling.

11. A method for controlling percussion rock drilling that includes the four sub-processes of percussion, rotation, feed and flushing that are controlled by adjusting drilling variables, the method comprising:

determining the penetration rate and percussion power of a rock drilling machine;

transmitting the obtained results to a control device of the rock drilling machine;

using the obtained results in controlling drilling;

determining in addition to the percussion power the power used by at least one other sub-process;

calculating the ratio of the total power used by the examined sub-processes to the penetration rate to determine the total specific energy used in drilling;

indicating the specific energy of at least one sub-process in a display of the control device; and adjusting the drilling variables so that a predetermined total specific energy is used in drilling.

12. The method of claim 11, comprising:

indicating said total specific energy in the display of the control device.

* * * * *